United States Patent [19]

Collier et al.

[11] Patent Number: 4,694,722

[45] Date of Patent: Sep. 22, 1987

[54] APPARATUS FOR SCORING AND CUTTING WALLBOARD AND THE LIKE

[75] Inventors: Ronald T. Collier, Columbus; Robert E. Thompson, Hebron, both of Ohio

[73] Assignee: Cardinal Industries, Inc., Columbus, Ohio

[21] Appl. No.: 763,044

[22] Filed: Aug. 6, 1985

[51] Int. Cl.[4] ..... B26D 3/08; B26D 1/24

[52] U.S. Cl. ..... 83/885; 83/51; 83/498; 83/436; 83/425.3; 225/2; 225/96

[58] Field of Search ..... 83/884, 885, 51, 493, 83/436, 425.4, 425.3; 225/2, 96

[56] References Cited

U.S. PATENT DOCUMENTS

| | | | |
|---|---|---|---|
| 2,254,413 | 9/1941 | Battershell | 83/51 X |
| 2,706,002 | 4/1955 | Whittamore | 83/885 |
| 3,332,326 | 7/1967 | Haas | 83/498 X |
| 3,491,632 | 1/1970 | Dovey | 83/885 |
| 3,788,371 | 1/1974 | Mason | 83/436 |
| 3,821,911 | 7/1974 | Seme | 83/885 X |
| 4,614,138 | 9/1986 | Altman | 83/51 |

*Primary Examiner*—Donald R. Schran

*Attorney, Agent, or Firm*—Wm. Cates Rambo; William S. Rambo

[57] ABSTRACT

A conveyor table is provided on a floor mounted support frame and a pair of tool guides are disposed horizontally and laterally above and below the conveyor table. Several readily removable tool and cutter assemblies, each having a freely rotatable, circular blade with teeth, are slidably mounted on the tool guides. Setscrews are provided on the tool and cutter assemblies to secure them on the tool guides in relatively opposing, vertically aligned pairs. Electrically powered drive units are disposed upstream and downstream of the tool and cutter assemblies to engage a sheet of wallboard, hold it against the conveyor table and move it between the opposing pairs of tool and cutter assemblies.

1 Claim, 4 Drawing Figures

APPARATUS FOR SCORING AND CUTTING WALLBOARD AND THE LIKE

TECHNICAL FIELD

The present invention relates to scoring and/or cutting machines for use on sheets of building material having outer layers of paperboard and a central layer of gypsum or the like, and more particularly to those which are provided with pairs of multi-positional blades for scoring opposing surfaces of the sheets of drywall, wallboard and the like.

BACKGROUND ART

In the construction of factory-built housing, economies are created by using production line techniques. As may be readily appreciated, a great deal of wallboard must be cut in a variety of shapes and sizes in order to build the inner walls and ceilings of such dwellings. Since there is a substantial amount of standardization, the shapes, sizes and number of pieces of wallboard or drywall that must be employed on a given production run may be determined quite accurately. Heretofore, however, it has not been possible to take full advantage of this knowledge because the desired cutting machinery was not available. When used on drywall, standard table saws created so much dust and the saw blades wore out so rapidly that maintenance and cleaning costs and health hazards outweighed their advantages. In addition, the only table saw known to the inventors to be especially adapted to score and cut drywall had a single pair of power driven rotary blades and thus was not much faster to use than hand-operated cutters.

The closest prior art known to the inventors are U.S. Pat. Nos. Re. 30,324 reissued July 8, 1980 to Seme; 3,610,079 issued Oct. 5, 1971 to Ashby; and 2,529,210 issued Nov. 7, 1950 to Butler. Seme discloses a device for forming score lines in a thin sheet of metal. The Seme scoring device is provided with upper and lower rotatable shafts on each of which is mounted a plurality of circular blades. While the relative positions and number of blades on each shaft may be changed, the means for doing so are cumbersome. In addition, the blades are not freely rotatable and either one or both of the shafts is power driven. While driven blades may be suitable for scoring relatively small pieces of metal, they tend to inject gypsum dust into the air when employed to cut wallboard. Ashby discloses a portable cutter provided with a pair of straight blades or knives that eliminate the dust problem, but the Ashby cutter cannot make multiple cuts simultaneously in the drywall. The blades are secured to pivotal arms extending from slides that move along upper and lower guide rails. Additional blade-bearing slides cannot be added because the existing pair of slides are rigidly secured to upper and lower handle bars by which their positions relative to the drywall workpiece are controlled. In addition, the blades tend to wear our quickly. Butler discloses cutter-bearing slides that are mounted in guide channels having relatively unobstructed ends, but the Butler device, like the Ashby cutter, is provided with straight blades or knives and is not adapted to make multiple cuts or scores in a sheet of wallboard. Thus, the Ashby and Butler drywall cutters are relatively portable, hand-operated tools more suited to on site construction work than to mass production. Likewise, the Seme device appears to be well suited for scoring metal plates, but not for scoring or cutting drywall.

Portable or hand operated drywall cutters are not practical in factory environments because they do not provide enough assistance to the operator and are not sturdy enough to withstand sustained use. Full size sheets of wallboard are so heavy and cumbersome that, absent substantial mechanical assistance, an average worker who handles such sheets repeatedly will tire rapidly. The cardboard and crushed gypsum stone of which the wallboard is composed require the application of a substantial amount of force to draw a hand-operated cutting tool through just the surface portions thereof. In addition, these materials tend to wear out straight knife blades rapidly. Thus, the present inventors were faced with a need for a heavy duty drywall cutter that would relieve the operator of lifting and moving the drywall, drawing the blade through opposing surfaces, making multiple cuts, and replacing the blades frequently.

DISCLOSURE OF THE INVENTION

An apparatus according to the present invention for scoring and cutting a workpiece of wallboard or the like basically comprises a floor mounted frame assembly; an elongated, central conveyor table horizontally disposed on the frame; a pair of laterally extending tool guides that are mounted on the frame, respectively, above and below the conveyor table; at least one pair of relatively opposing tool and cutter assemblies, each of which is slidably mounted on and readily demounted from one of the tool guides; fastening means for securing each tool and cutter assembly to its respective guide; and at least one drive unit disposed above the conveyor table to engage the workpiece, hold it against the conveyor table and move it between the pair of relatively opposing tool and cutter assemblies. Each of the tool and cutter assemblies is provided with a circular blade rotatively mounted thereon.

A primary object of the present invention is to provide multiple score lines or cuts in sheets of wallboard with minimal amounts of dust being injected into the air. Another object is to provide a drywall cutter wherein the number and positions of the score lines and cuts may be changed rapidly. A further object is to provide a drywall cutter of high output capacity. Yet another object is to provide a durable drywall cutter whose blades do not wear out rapidly. Further objects and advantages of the present invention may be more readily perceived in view of the following drawings and description.

MODE FOR CARRYING OUT THE INVENTION

Figures 1, 2:
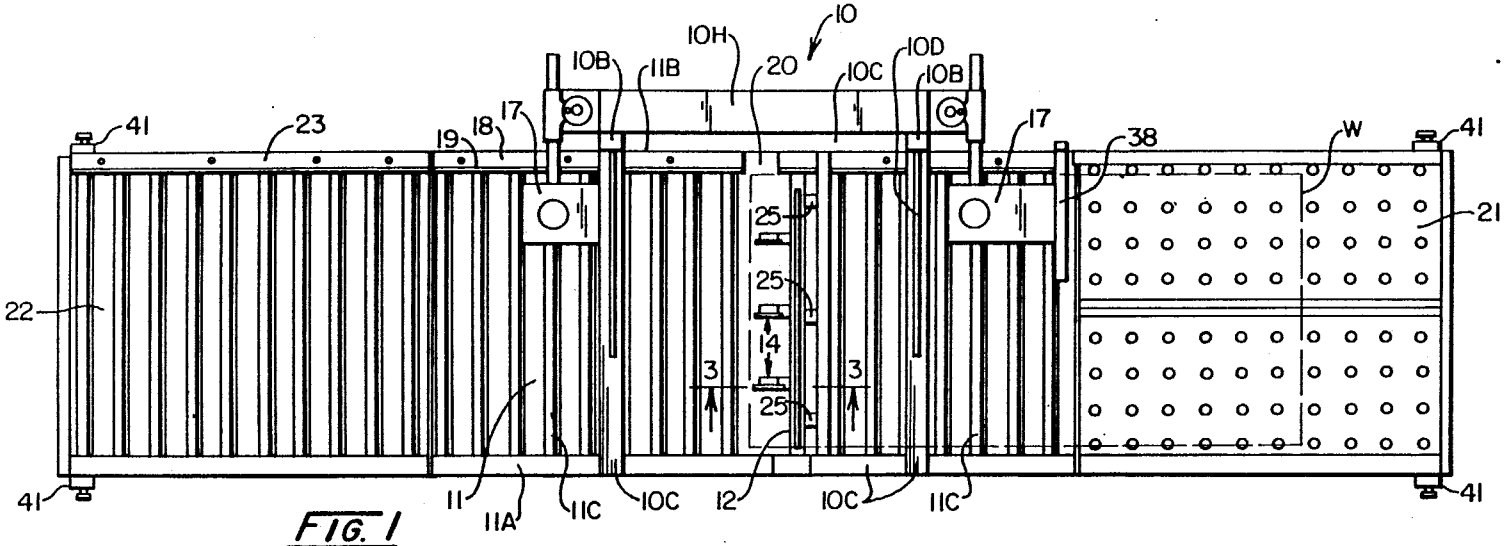
FIG. 1 is a top plan view of a drywall cutter according to the present invention and particularly illustrates the relatively narrow profile of the tool and cutter assemblies.
FIG. 2 is a side elevational view of the drywall cutter shown in FIG. 1 and particularly illustrates the relative alignments of the rollers, workpiece and drive units.

As indicated in FIGS. 1 and 2, an apparatus according to the present invention for scoring and cutting a workpiece W of wallboard or the like basically comprises a floor mounted frame assembly, generally designated 10; an elongated, central conveyor table 11 horizontally disposed on the frame; a pair of laterally extending tool guides 12 and 13 mounted on the frame respectively above and below the conveyor table; at least one pair of relatively opposing tool and cutter assemblies, generally designated 14 and 15, each mounted on one of the tool guides; a fastener 16 (FIG. 3) or other means for securing each tool and cutter assembly to its respective guide; and at least one drive unit 17 disposed above the conveyor table to engage the workpiece, hold it against the conveyor table and move it between the pair of relatively opposing tool and cutter assemblies.

The frame assembly 10 is an open structure and is formed from a plurality of relatively sturdy members that are fashioned, preferably, either from square tubing, plates or angular pieces of quarter inch steel. Four spaced apart uprights or legs 10A extend from the floor to positions adjacent to either a front side rail 11A or a back side rail 11B of the central conveyor table 11. A pair of pillars 10B are mounted on the legs 10A adjacent to the back side rail 11B of the conveyor table 11 and project above said table. An additional pair of pillars are not provided, however, on the legs 10A that are adjacent to the front side rail 11A of the conveyor table so that passage of the workpiece W, if it extends laterally beyond the front side rail of the table, will not be impeded. An upper horizontal lattice 10C projects laterally from the pillars 10B and is suspended above the table with the support of gussets 10D. A lower horizontal lattice 10E is supported by the legs 10A. A diagonal brace 10F extends from each of the legs 10A to one of the corners of the conveyor table 11. An elongated bracket 10G extends between the ends of the diagonal braces 10F and lies adjacent to each end of the conveyor table. A platform 10H is disposed behind and is partially supported by the legs 10A adjacent to the back side rail 11A of the conveyor table. In addition, a table-supporting beam (not shown) extends between each laterally opposing pair of legs 10A. The abutting portions of the various members of the frame assembly 10 are welded together except where it is advantageous to provide removable fasteners, such as at opposite ends of the diagonal braces 10F. In this manner, the diagonal braces and the elongated brackets 10G may be removed, thereby making the frame assembly 10 more compact for shipment.

As further indicated in FIGS, 1 and 2, the central conveyor table 11 is supported by and bolted to the legs 10A, diagonal braces 10F, elongated brackets 10G and transverse beams (not shown) of the frame assembly 10. In addition to the longitudinally extending, laterally spaced apart front and rear side rails 11A and 11B, said conveyor table 11 is provided with a plurality of elongated, horizontally disposed rollers 11C extending laterally between and rotatively mounted on said side rails 11A and 11B. The rollers 11C are parallel to one another and are spaced generally equally apart, except in the middle of the conveyor table 11, where a substantial gap is provided for the tool and cutter assemblies 14 and 15. An elongated datum or zero line workpiece guide 18 is mounted on the back side rail 118 and projects above the rollers 11C which, in turn, project above the side rails 11A and 11B. Preferably, the zero line guide 18 is provided with a wear-plate 19 formed from low friction synthetic resin material and against which one edge of the wallboard workpiece W slides. Vertically aligned gaps 20 are provided in the middle of the back side rail 11B, the workpiece guide 18 and the wear plate 19 so that the tool and cutter assemblies 14 and 15 can be readily removed or mounted on the ends of the tool guides 12 and 13 adjacent to said gaps 20. Preferably, an insert (not shown) is provided in the gap 20 in the workpiece guide 18 and wear plate 19. It is also advantageous, at times, to equip the front side rail 11A with an edge guide (not shown) that is spaced from the zero line guide 18 a distance equal to the width of the drywall W. In this manner, proper alignment of the workpiece W as it passes longitudinally between the opposing tool and cutter assemblies 14 and 15 is further assured.

Preferably, entrant and exit transfer tables 21 and 22, respectively, (FIGS. 1 and 2) are disposed in abutment with opposite ends of the central conveyor table 11 in order to assist the operator in positioning and guiding the workpiece and to provide additional support therefor both before and after it is scored and partially cut. The entrant transfer table 21 may be equipped with spherical antifriction elements which facilitate rotational, as well as linear, movement of the sheet of drywall in the event that it is to be scored and cut across its width, rather than longitudinally. The exit transfer table 22, however, is ordinarily equipped with elongated, laterally extending rollers, such as those provided on the central conveyor table 11. In addition, the exit transfer table 22 may be provided with a guide extension 23 to maintain proper alignment of the workpiece as the tail end thereof is passing between the tool and cutter assemblies 14 and 15. Each of the transfer tables 21 and 22 may be equipped with adjustable legs or floor supports 24 so that the spherical or elongated rollers thereon are coplanar with the rollers of the central conveyor table 11.

As indicated alternately in FIGS. 1 and 2, the upper tool guide 12 is mounted on three relatively spaced apart locating arms 25 projecting downwardly from a cross member of the upper lattice 10C, and the lower tool guide 13 is mounted on three relatively spaced apart locating arms 26 projecting upwardly from the lower lattice 10E. The locating arms 25 and 26 are disposed, respectively, on the upper and lower lattices 10C and 10E to provide relatively opposing, vertically aligned pairs of locating arms disposed above and below the conveyor table 11. In this manner, the upper 12 and lower 13 tool guides are aligned with one another and are disposed between the conveyor table and the upper and lower lattices to permit unobstructed movement of the tool and cutter assemblies that are slidably mounted thereon.

Figure 3:
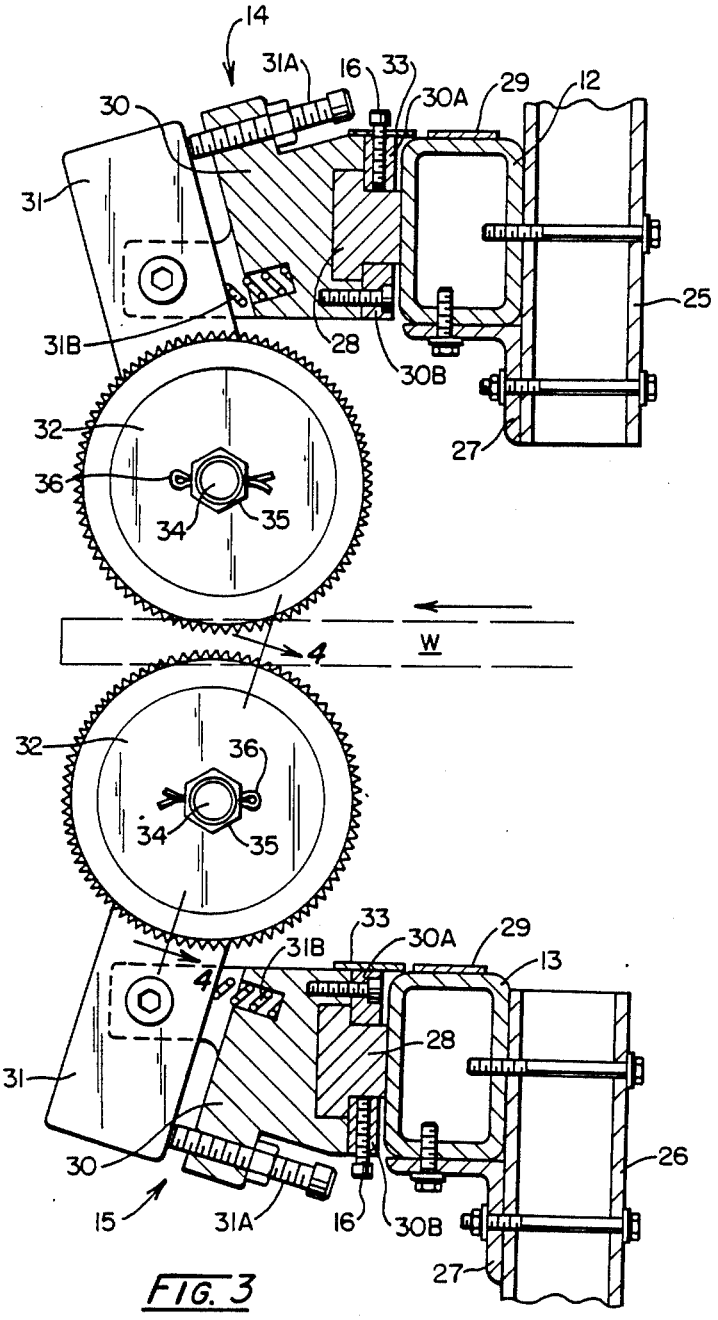
FIG. 3 is an enlarged vertical sectional view taken along line 3—3 of FIG. 1 and particularly illustrates a preferred manner in which the tool and cutter assemblies of the present invention are constructed and their relative alignment with the workpiece.

As indicated in FIG. 3, the tool guides 12 and 13 and the tool and cutter assemblies 14 and 15 slidably mounted thereon are constructed and positioned so that the workpiece W passing between the tool and cutter assemblies is scored and partially cut on both sides thereof. Each of the upper and lower tool guides 12 and 13 is bolted to its respective locating arms 25 and 26 and to an elongated, underlying, L-shaped support 27 which is also bolted to the locating arms. An elongated bar or mount 28 that is generally T-shaped in cross section is fastened to each of the tool guides 12 and 13 by capscrews or the like and establishes the channels by which the tool and cutter assemblies 14 and 15 are slidably mounted on the guides. A scale 29 is provided on the upper surface of and is longitudinally coextensive with each of the tool guides 12 and 13. Each scale is aligned precisely with the other.

As further indicated in FIG. 3, each of the tool and cutter assemblies 14 and 15 includes a body or retainer 30, a blade arm 31 pivotally mounted on the body, and a circular blade 32 rotatively mounted on the arm. Each assembly has a relatively narrow profile (FIG. 1), preferably within a maximum thickness of two to three inches, so that two or more of the assemblies can be mounted on the same tool guide in relatively close proximity to one another and thereby provide closely spaced apart cuts in the workpiece W when such cuts are desired. The body 30 is formed with a channel which is shaped and positioned to receive the T-shaped bar 28 of the tool guide 12 or 13 upon which the tool and cutter assembly 14 or 15 is mounted. Inwardly projecting contacts 30A and 30B which occupy the channels established by the T-shaped bars 28 of the tool guides are secured by capscrews or the like to the body of each of the tool and cutter assemblies. An indicator 33 is centered on and secured to the upper surface of each of the contacts 30A that lie adjacent to the scales 29 on the tool guides, and each of the indicators 33 is formed with a point that extends almost to the adjacent tool guide scale. In addition, one setscrew or capscrew 16 is threadably mounted in the indicator-bearing contact 30A on the upper tool and cutter assembly, and another projects downwardly through the opposite contact 30B on the lower tool and cutter assembly. The setscrews 16 are disposed to engage and disengage the T-bars 28 of the tool guides. In the usual manner, the setscrews are tightened to hold the tool and cutter assemblies 14 and 15 in the desired positions on the tool guides 12 and 13, and are reversed when the tool and cutter assemblies need to be repositioned or removed. As may be readily understood, the tool and cutter assemblies are releasably secured to their respective tool guides in relatively opposing, vertically aligned pairs so that the scores and cuts on the opposing surfaces of the workpiece are aligned with one another and even break lines are provided thereon.

The blade arm 31 is pivotally mounted at an oblique angle on the body 30 of each of the tool and cutter assemblies by means of a shoulder bolt and projects angularly towards the direction of movement of the workpiece, as indicated by the directional arrow in FIG. 3. Its position relative to the body is controlled by another capscrew or setscrew 31A and a die spring 31B, each mounted in the bodies of the assemblies. By manipulating the setscrews 31A, the angle of the blade arms relative to the bodies on which they are pivotally mounted is altered, and the height of the blades 32 relative to the workpiece W is adjusted thereby. Each of the die springs 31B, in turn, serves as a resilient counterforce to the setscrew 31A and to the pivotal movement of the blade arm 31 and prevents the blade 32 or said blade arm from being damaged when variations or irregularities in the drywall or encountered.

Figure 4:
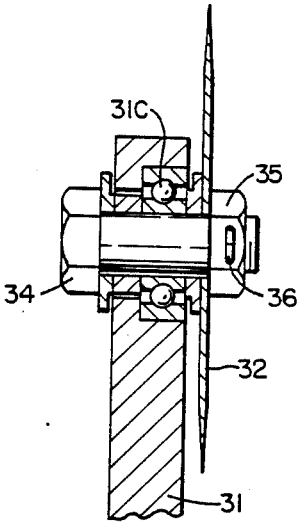
FIG. 4 is a further enlarged oblique sectional view taken along line 4—4 of FIG. 3 and particularly illustrates a preferred manner in which the blade according to the present invention and the bearing by which it is rotatably mounted on the tool and cutter assembly are constructed.

As indicated in FIGS. 3 and 4, the circular blade 32 rotatively mounted on each of the tool and cutter assemblies is formed with a plurality of aligned teeth projecting radially outwardly from a double bevelled circumferential edge portion thereof. The teeth perforate the adjacent cardboard outer layer of the wallboard workpiece and bite partially into the central gypsum layer, and the double bevelled edge portion of the blade completes the cut. The teeth, in effect, prevent the bevelled cutting edge of the blade from wearing out quickly. In addition, since the teeth are aligned with one another, rather than being alternately offset, a relatively narrow split or cut line can be formed in the workpiece. The blade 32 is mounted on an arbor 34, and a captured thrust bearing 31C is provided in a bore formed in the arm 31 and through which the arbor projects. In this manner, the circular blade 32 is freely rotatable on the arm 31. As a result of this free rotation, wear is evenly distributed over the entire cutting edge of said circular blade. A slotted nut 35 is provided at the opposite end of the arbor 34, and a cotter pin 36 is inserted in the nut 34 to ensure that the nut and the blade 32 will not come off inadvertently.

As further indicated in FIGS. 1 and 2, the present drywall cutter is provided with at least one, and preferably two, drive units 17. Said drive units are mounted on opposite ends of the drive platform 10H and extend over the conveyor table 11. Relative to the right to left movement of the workpiece in FIG. 2, the drive units are disposed, respectively, in advance of and following the tool and cutter assemblies 14 and 15. Each drive unit is equipped with an electrically powered motor and with a set of drive wheels 37 that engage the workpiece, hold it against the conveyor rollers 11C and move it through the opposing pairs of tool and cutter assemblies. Preferably, the drive wheels are provided with low durometer, synthetic resin covers that can grip the drywall without damaging it.

In addition, the wheels 37 are angled slightly toward the workpiece guide 18 so that the workpiece W is constantly pressed against said guide 18 as it passes through and beyond the tool and cutter assemblies 14 and 15. The height of the wheels 37 relative to the conveyor table rollers 11C can be adjusted to accommodate various thicknesses of wallboard. In addition to the drive platform 10H, the drive units are held in position by stationary, horizontal arms 38 that are connected to the frame assembly 10. In this manner, the drive units are held stationary relative to the conveyor table, while the height of the drive wheels is adjustable.

A housing 39 is provided for some of the electrical components with which the present drywall cutter is equipped. Preferably, the present apparatus is provided with a main on/off switch 40 supported on the front of the upper lattice 10C, emergency stop buttons 41 at opposite end corners of the entrant and exit transfer tables 21 and 22, and with limit switches or optical sensing devices (not shown) which control the power to the drive units 17 in response to the presence or absence of a workpiece impinging thereon.

Operation of the present wallboard cutter is as follows. First, the operator determines the sizes of the pieces of material to be cut from a sheet or sheets of drywall. Additional tool and cutter assemblies 14 and 15 are either mounted on or removed from the tool guides 12 and 13 along the backside rail 11B as a result of these size determinations and are positioned on said guides in accordance therewith. Opposing pairs of tool and cutter assemblies are positioned at the same location on their respective tool guides 12 and 13 by means of the indicators 33 on the bodies of the assemblies and the scales 29 on the guides. The tool and cutter assemblies are then locked in position by tightening the setscrews 16. Next, the depths of the cuts to be made in the drywall are determined and the blade arm setscrews 31A are advanced or retracted accordingly. Likewise, the height of the drive units 17 is checked or adjusted to accord with the thickness of the drywall.

A scissor lift table (not shown) loaded with drywall is positioned at the end of the entrant transfer table 21 and is adjusted to raise itself so that the height of the top piece of drywall is maintained at the level of the table as the drywall is removed. An empty scissor lift table (not shown) is positioned at the end of the exit transfer table 22 and is adjusted to lower itself so that the height of the last piece of cut drywall thereon is equal to the exit table height. The operator then turns on switch 40 at the front end of the upper lattice 10C and walks back to the load of uncut drywall. He or she places the uncut workpiece on the entrant transfer table 21, rotates it if necessary, and aligns one edge thereof with the workpiece guide 18. The workpiece is then urged forwardly until the first limit switch or optical device is tripped and the adjacent drive unit 17 engages the workpiece. The first drive unit will then push the workpiece along through the opposing pairs of tool and cutter assemblies 14 and 15, whereupon advance portions of the workpiece are scored and cut. As the workpiece advances, the leading edge trips a second limit switch or optical device and is engaged by the downstream drive unit 17. The power to the upstream drive unit motor is switched off once the trailing edge of the workpiece has advanced beyond the drive wheels 36 and has tripped a third limit switch. Since the opposing tool and cutter assemblies, 14 and 15 do not cut completely through or sever the drywall, the downstream drive unit 17 is able to pull the trailing portion of the workpiece through the blades, even though its drive wheels engage only a relatively narrow section of the workpiece. Power to the downstream drive unit 17 is shut off by a fourth limit or optical switch once the trailing edge of the scored and cut wallboard has cleared said drive unit. At this point, the wallboard is lying in one piece on the exit transfer table 22, and the operator may either push it as a unit onto the empty scissor lift or separate it into sections and then load the drywall sections on the lift.

In this manner, a drywall cutter is provided which relieves the operator substantially from the burden of manipulating and cutting cumbersome sheets of material, thereby permitting increased production. In addition, it permits the number and positions of the cuts to be changed rapidly. Since its blades are circular, freely rotating and provided with teeth, they do not wear out quickly. By the same token, little or no gypsum dust is carried into the air and, since the blade teeth are aligned, the cuts in the drywall are relatively thin.

While a single preferred embodiment of the present invention has been described and illustrated in some detail, various modifications may be made without departing from the spirit of the invention or the scope of the following claims.

We claim:

1. Apparatus for cutting a workpiece of sheet material such as wallboard, plasterboard or the like, said apparatus comprising:

(a) a floor mounted support frame;

(b) a table disposed on the frame for carrying the workpiece in a generally horizontal plane;

(c) drive means mounted on the frame and disposed above the table for holding the workpiece against said table and for moving said workpiece in a selected direction of travel;

(d) a pair of relatively elongated spaced apart, parallel, vertically aligned, stationary tool guides extending from the support frame generally transversely to the direction of travel of the workpiece and disposed, respectively, above and below the table, each of said tool guides having at least one free end;

(e) at least one tool assembly slidably mounted on and readily removable from the free end of each of the tool guides and provided with means for releasably locking said tool assembly in any of a plurality of selected positions on said tool guide; and (f) a generally circular blade freely rotatable one each tool assembly and disposed thereon for penetrating the workpiece as said workpiece is moved along the table, said blade being formed with a plurality of circumferentially aligned teeth projecting radially outwardly from a tapered, peripheral edge portion of said blade.

* * * * *